United States Patent [19]

Jaeger et al.

[11] Patent Number: 5,075,586

[45] Date of Patent: Dec. 24, 1991

[54] HIGH-PRESSURE DISCHARGE LAMP AND HOLDER STRUCTURE FOR AN ARC DISCHARGE TUBE THEREIN

[75] Inventors: Guenter Jaeger, Berlin; Karl Muntrich, Affing; Peter Wirtz, Kissing, all of Fed. Rep. of Germany

[73] Assignee: Patent Treuhand Gesellschaft für elektrische Gluhlampen mbH, Munich, Fed. Rep. of Germany

[21] Appl. No.: 540,215

[22] Filed: Jun. 18, 1990

[30] Foreign Application Priority Data

Jul. 13, 1989 [DE] Fed. Rep. of Germany ... 8908561[U]

[51] Int. Cl.[5] ..... H01J 9/26; H01J 17/02; H01J 61/34

[52] U.S. Cl. ..... 313/25; 313/634; 445/26

[58] Field of Search ..... 313/25, 634; 445/23, 445/26, 44

[56] References Cited

U.S. PATENT DOCUMENTS

| | | | |
|---|---|---|---|
| 2,562,887 | 8/1951 | Beese | 313/25 X |
| 2,671,183 | 3/1954 | St. Louis et al. | 313/25 X |
| 4,829,210 | 5/1989 | Benson et al. | 313/25 |

FOREIGN PATENT DOCUMENTS

| | | |
|---|---|---|
| 3122665 | 3/1982 | Fed. Rep. of Germany . |
| 3739008 | 5/1989 | Fed. Rep. of Germany . |
| 215208 | 10/1984 | German Democratic Rep. . |

*Primary Examiner*—Sandra L. O'Shea
*Attorney, Agent, or Firm*—Frishauf, Holtz, Goodman & Woodward

[57] ABSTRACT

To guide a double-ended arc tube (8) within an outer bulb (2), a sheet metal guide element (17, 17') is secured to a support rod (12) of a holder structure (6a, 6b, 7, 12) extending within the bulb, the sheet metal part (17) having a major surface extending at least approximately transversely to the lamp axis (A) and being formed with an opening (24) fitting around and loosely, resiliently recieving a press seal (10) of the arc discharge tube (8). Preferably, the opening (24) is rectangular, and depending flaps (25, 26) extend from the sides of the opening to resiliently grip the press seal. The flaps may be reduced adjacent their junction with the rim (22, 23) surrounding the opening (24) of the guide element, so that a single guide element can receive different sizes of arc tubes having differently shaped press seals (10, 15). The holder effectively compensates for thermal expansion of materials in operation of the lamp, while securing the arc tube reliably in position even when subjected to shock or vibration.

12 Claims, 3 Drawing Sheets

HIGH-PRESSURE DISCHARGE LAMP AND HOLDER STRUCTURE FOR AN ARC DISCHARGE TUBE THEREIN

Reference to related patent, the disclosure of which is hereby incorporated by reference: U.S. Pat. No. 4,376,259, Rothwell et al.

Reference to related publication: German Patent 30 06 846 (to which Canadian 1,135,781, corresponds), Kuus et al.

FIELD OF THE INVENTION

The present invention relates to a high-pressure discharge lamp, and more particularly to an arrangement to hold an arc discharge tube within an outer envelope, and on a base structure of the lamp, and to the assembly of such a completed lamp.

BACKGROUND

High-pressure discharge lamps to which the present invention relates are frequently used with arc discharge tubes of quartz glass, including a fill of a metal halide, retained within an outer envelope. Lamps of this type having a power rating of between 100 to 1000 W require a stable, sturdy holder mount which retains the discharge vessel in position within an outer bulb. Different thermal coefficients of expansion of the materials and different thermal expansions of the various components of the lamp cause problems. Additionally, such lamps may be subjected to shock or vibration, and rough handling, particularly during shipment. Deformation of the holder structure or misplacement of the arc discharge tube upon being subjected to such shocks or to vibration must be avoided. Breakage of the lamp bulb, and especially of the arc tube, likewise should be avoided; thus the arc tube should be reliably held within the vessel while, however, absorbing external shocks.

It has been proposed to use double-ended arc tubes having pinch or press seals at the respective ends. These pinch or press seals are secured to the support structure within the lamp by placing a sheet metal collar around one or both of the pinch or press seals and securing the collars to the support structure within the lamp, which is also secured to the base thereof.

Use of collars permits guidance of the discharge vessel in the axial position within the lamp, however permits expansion only in axial direction. A lateral deflection of the lamp, for example by a blow or impact against the lamp as a whole, is not possible. Guide elements using collars are shown, for example, in the referenced U.S Pat. No. 4,376,259, Rothwell et al, as well as in German 30 06 846, Kuus et al. It has been found that the use of such collars interferes with automated manufacture of the lamps and economical assembly thereof, and, additionally, does not provide the required resistance of the lamp as a whole to impacts thereagainst which may arise, for example upon shipment of the lamp when a package of lamps, for example, is thrown on a transport belt or the like.

THE INVENTION

It is an object to improve a high-pressure discharge lamp and especially the holding arrangement for the arc discharge tube, so that a simplified arrangement is provided which permits automatic assembly of the lamp, by assembly machinery, while providing for improved resistance to shock or vibration and maintenance of the design position of the arc tube within the lamp bulb.

Briefly, a guide element is secured to a holder structure within the lamp, the guide element being formed by a punched sheet metal part having a major surface extending at least approximately transverse to the lamp axis. The sheet metal part is formed with an opening fitting around and loosely, receiving one of the press seals of the arc tube. The other press seal of the arc tube may be held within a bulb by a spring clip. Preferably, the punched sheet metal part is so made that the region adjacent the opening is defined by flaps, punched out from the sheet metal, which flaps extend at an angle away from the center of the arc tube, so that the arc tube can be readily assembled by pushing it through the opening, with the flaps resiliently engaging the pinch or press seal. The opening, typically, is of essentially square cross section, and the flaps may extend from all four sides thereof.

The arrangement has the particular advantage that a single sheet metal part may be used for various types of lamps, that is, for lamps having cylindrical or elliptical outer bulbs. Thus, differential stocking of parts can be avoided. Additionally, the resistance of the lamps to shocks or impact is improved. This has been proved by experiments subjecting the lamp to free fall, as well as to vibration on a vibration test stand.

Fully automatic assembly of the lamp is greatly facilitated by use of the sheet metal guide, which thus permits fully automated assembly thereof. The opening in the sheet metal element loosely, surrounds the pinch or press seal and the flaps resiliently engage the sides of the pinch or press seal. This permits the pinch or press seal to be secured in a self-holding arrangement, greatly facilitating the production step, and assembly of the arc discharge tube into its holder structure.

The use of a sheet metal element additionally permits a construction which reduces the number of spot welds in manufacture of the lamp. By careful selection of the material of the holder part, high-quality weld connections can be obtained, and the reliability thereof improved with respect to prior art welds. The preferred material is an iron base coated with a nickel layer, known by the commercial name of "Hilumin". The holder part is bent, for example at right angles, to form a bent-over arm which is shaped in undulating form. This permits bump-welding of ridges of the undulating arm to a guide and support portion of the holder mount. Such welding is simple and provides better welds than other weld connections.

The flaps depending from the punched opening permit better matching of the overall guide part to the pinch seal of the arc tube than collars fitted thereabout. The pinch or press seals of the arc tubes are not all precisely identical, and the resilient flaps can fit against the individual pinch seals. The flaps, which resiliently hold the pinch or press seal and engage thereagainst with spring force, matching themselves to the shape of the pinch or press seal, also prevent breakage of quartz particles from the pinch seals, and especially breakage of the entire pinch or press seal when the lamp is subjected to shock or vibration, for example upon being shipped through the mail. When transported, the lamp may be subject to rhythmically occurring vibrations or individual rapid acceleration, which, under worst-case conditions, may lead to resonant oscillations of the arc discharge tube within the lamp. The resilient holder flaps effectively prevent the occurrence of such resonant oscillations.

It has been found particularly suitable to so shape the resilient flaps that their width, with respect to the overall length of the side from which they are punched, is small. Such an arrangement permits assembly of lamps of different power ratings, and which, then, will have differently dimensioned pinch or press seals with the same guide parts, thus substantially reducing overall manufacturing costs.

The resilient action of the flaps can be increased by forming a crease and/or a reduced region on the flaps in a portion thereof where they join the rim of the opening of the guide part.

The invention is particularly suitable for lamps having a base at only one end of an outer bulb, although it is not restricted thereto.

DRAWINGS

DETAILED DESCRIPTION

Figure 1:
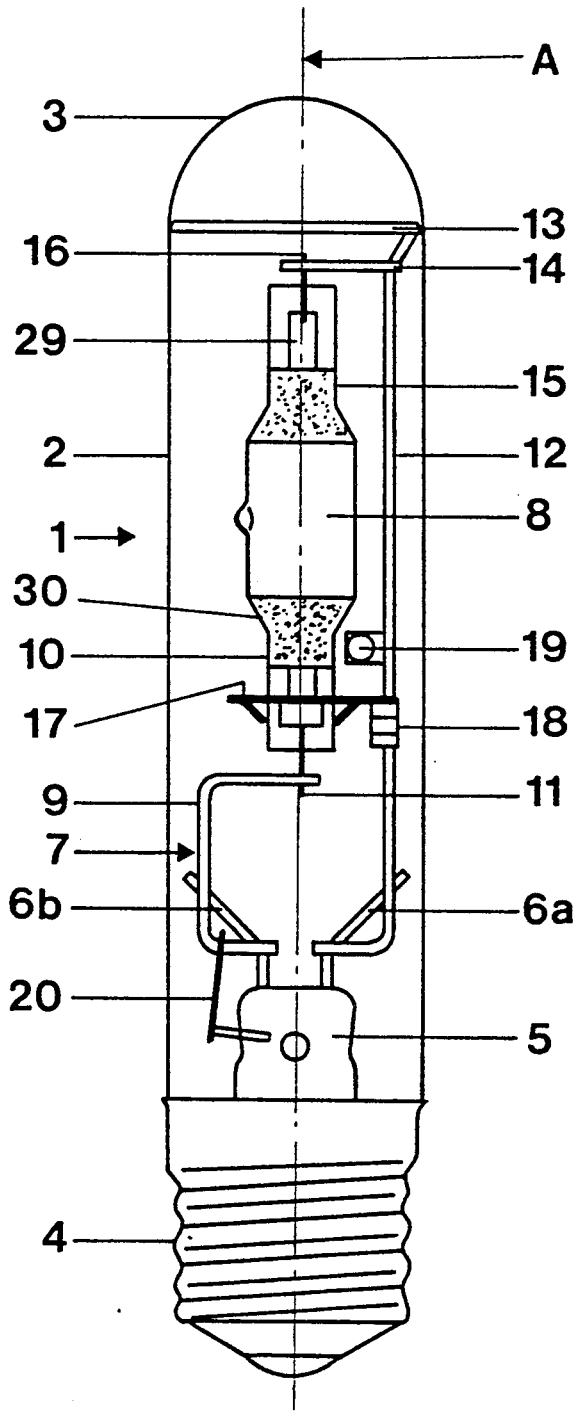
FIG. 1 is a schematic side view of a high-pressure discharge lamp with a metal halide fill.

The present invention is particularly applicable to single-ended metal halide lamps 1. FIG. 1 illustrates such a lamp of, for example, 250 W rated power. It has an outer bulb 2, which may be cylindrical or elliptical. made of hard glass. The end of the lamp remote from base 4 is a rounded cap 3. Base 4 is a typical standard screw-in base. A flare mount 5 is secured in the base 4, as well known, through which two supply leads 6 extend into the interior of the bulb 2. The supply leads 6 are electrically connected to the connecting parts of base 4, as well known. The supply leads 6, which are formed by the individual leads **6*a* and 6*b*, collectively form a holder assembly or holder means 7 for the arc discharge tube 8 located axially aligned within the bulb 2. One of the supply leads, namely lead 6*b*, is connected to a generally U-shaped wire element 9 which extends to the end lead 11 extending from the pinch or press seal 10 adjacent the base 4, and projecting away from the center of arc tube 8. The other supply lead 6*a* is welded to a massive metallic support rod 12 extending longitudinally within the bulb 2, and parallel to the axis of the lamp, towards the cap 3**.

For ease of description, the end of the lamp adjacent the base 4 will, hereinafter, be referred to as the "base end" and the other end thereof as the "remote end".

The remote end of the metal support rod 12 is bent over at right angles with respect to the axis of the lamp to form a partial, essentially part-circular loop 13 which engages with its circumference at the inside of the bulb 2, roughly in the region of the junction between the cap 3 and the elongated portion of the bulb 2. A massive nickel wire 14 is secured to the support rod 12, for example by welding, somewhat below the part-circular portion 13, and connected, for example by welding, with the current supply lead 16 extending from the remote pinch seal 15 of the arc tube 8.

Two getters 19, 20 are secured within the bulb 2, for example, as shown, getter 19 being secured to the support rod 12 and getter 20 to a metal pin melted into the mount 5. The getters are provided to maintain vacuum within the outer bulb 2.

A guide element is provided within the lamp to guide the arc tube 8 therein. In accordance with a feature of the invention, the guide element is a punched sheet metal part 17, having a bent-over arm 18 which is attached to the support rod 12. The punched metal part 17 guides the arc tube 8. It extends transversely to the longitudinal axis A of the lamp in the region of the base pinch seal 10, and surrounds the base pinch seal 10 roughly in the middle of its length. This arrangement provides a particularly effective limitation of amplitude of deflection of the arc tube in case the lamp is subjected to shock or vibration. It also permits elimination of a second guide element at the remote end.

The arc discharge tube 8 is made of quartz glass, and, for example, has a cylindrical discharge vessel which includes a fill of an inert gas, mercury, and at least one metal halide. Two electrodes which are axially aligned to face each other are connected by connecting foils 29 through the pinch seals 10, 15, to provide an electrical connection between the external current supply leads 11, 16 and the electrodes of the lamp, which have been omitted from the drawing for clarity, since they can be in accordance with any well known construction. The connecting foils 29 are embedded in the pinch seals 10, 15 which are coated with a heat damming or heat retention layer 30, extending up to the electrodes.

Figure 3:
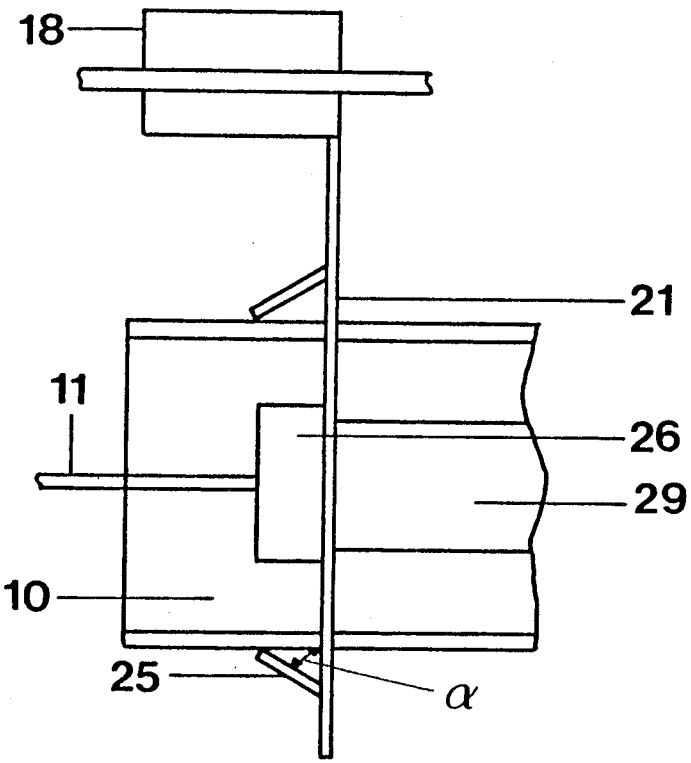
FIG. 3 is a side view of the guide part, and illustrating the pinched seal only schematically.
Figure 2:
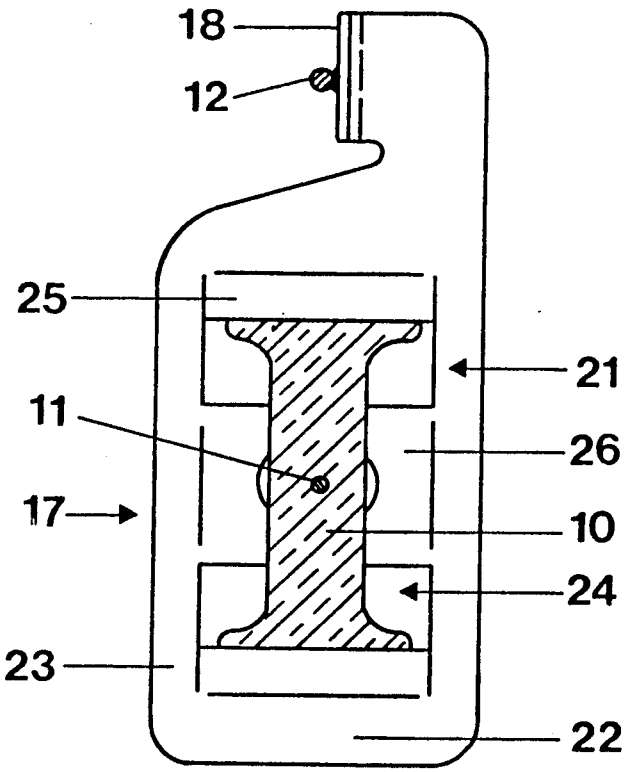
FIG. 2 is a top view of a guide part and pinch seal of an arc tube on-.which the guide part is pushed.

In accordance with a feature of the invention, and as illustrated in detail in FIGS. 2 and 3, the guide part 17 is punched to define a roughly rectangular frame 21 with rounded edges. The material of the punched part is, for example, an iron-base nickel-coated sheet, known under the trade name "Hilumin", of for example about 0.5 mm thickness. The two narrow sides 22 have a width of about 13.5 mm, and the two longer sides 23 have a width of about 22 mm. The frame 21 surrounds and defines a generally rectangular opening 24. The width of the frame portions 22, 23 is about 2 mm.

In accordance with a preferred feature of the invention, flaps 25 extend from the edges of the opening towards the pinch seal 10 from the narrow sides of the essentially rectangular opening and, similarly, flaps 26 extend from the longer side of the opening, so that flaps 25, 26 extend from each of the four sides. The flaps are resilient The flaps at the cross sides or narrower sides extend over the full length of the cross side 22 of the frame 21. They are bent at an angle of about 45° from the major plane of the sheet metal part 17. The flaps 26 at the longitudinal sides 23 are reduced in length by the width of the transverse flaps 25 with respect to the entire length of the longitudinal side 23. They are, like the flaps 25, bent by an angle of about 45° from the part 17, so that the four flaps leave an effective opening which corresponds roughly to the double-T shaped cross section of the pinch seal of the arc discharge tube 8.

An arm 18, for example integral with the punched part 17, is secured to the support rod 12, to attach the part 17 to the internal structure of the lamp. It is bent in the same direction as the flaps 25, 26, however bent over by about 90° The arm 18 is undulated or corrugated—see FIG. 6—and thus defines two ridges or bumps, which substantially facilitates welding the arm 18 to the support rod 12.

Figure 6:
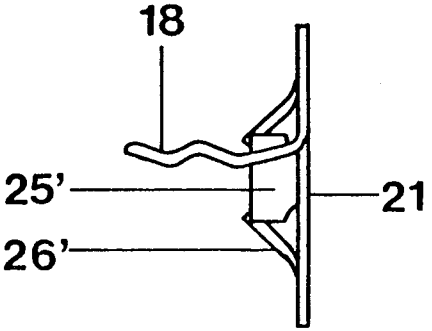
FIG. 6 is a view of the guide part, rotated 90° with respect to the illustration of FIG. 5, without the pinch seal of an arc tube therein.
Figure 5:
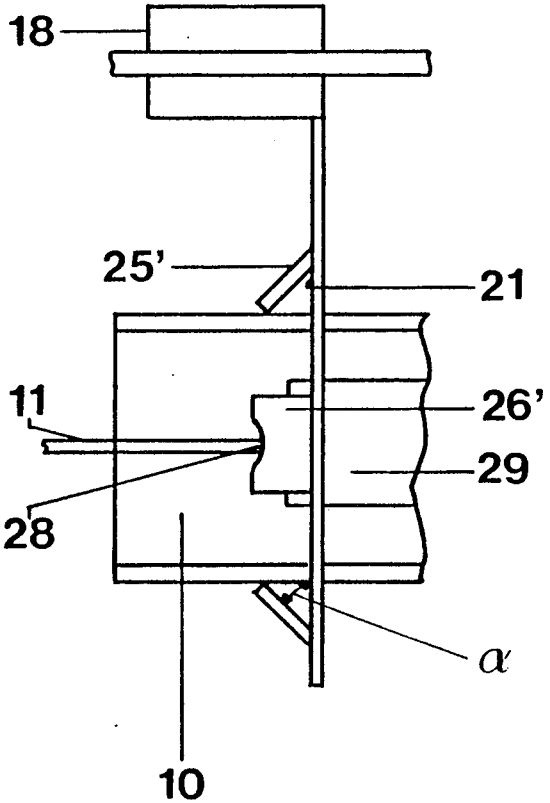
FIG. 5 is a side view of the guide part of FIG. 4.
Figure 4:
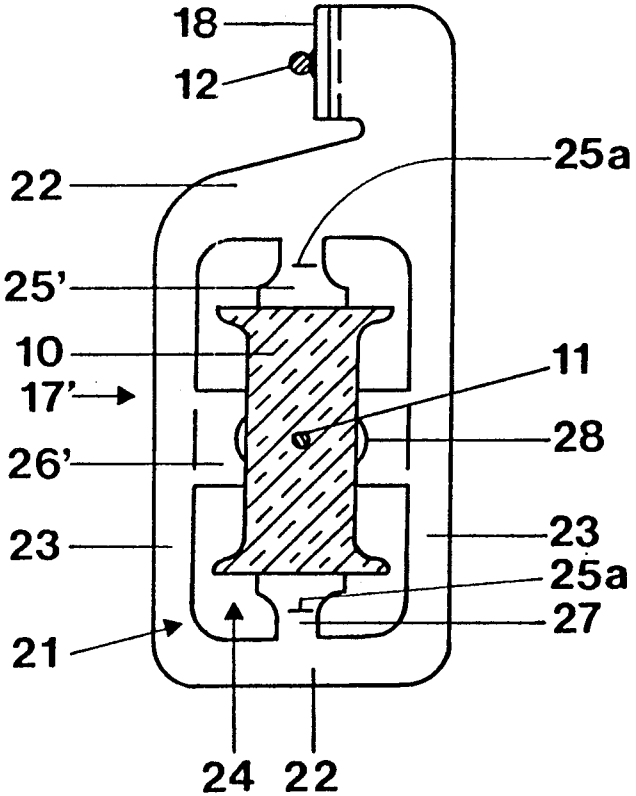
FIG. 4 is a top view of another embodiment of the guide part, pushed on the pinch seal of an arc tube.

The part 17 can be shaped differently, and FIGS. 4–6 illustrate another embodiment, in which the same reference numerals have been used, and to the extent that the components are different, have been given prime notation.

The length of the flaps 25', 26' is substantially shorter than the flaps 25, 26 of FIGS. 2 and 3, although their width is about the same. The length of the flaps, uniformly, is about 4 mm, which corresponds to 20% of the length of the wider side 23 of the frame and 40% of the length of the narrower side 22. The effective opening thus is uniformly larger. The flaps 25' at the narrower sides are recessed in the region of the junction 27 to the adjacent frame part 22 to a width of only about 2 mm, to increase the resiliency or springiness of the flaps.

The flaps extending from the longitudinal sides 23 of the part 17' are formed with essentially part-semicircular recesses 28, facing each other. These recesses are used to guide the guide element 17' during its manufacture, and to move the guide element in position upon assembly in the lamp, and the lamp mount.

The construction in accordance with the embodiment of FIGS. 4 and 5 is particularly suitable to be used with lamps of different power ratings, or different types, since the guide element 17' can self-adjust to different shapes and sizes of the pinch seal 10 of the respective arc tube. Differential dimensions of the arc tube can readily be compensated by change of the bending angle of the flaps, shown in FIG. 5 at $\alpha$, to thereby compensate for different dimensions of the pinch seal 10.

The flaps can, additionally, be matched to different sizes of the pinch seal by varying the bending point about which the flaps are bent from the major plane of the part 17, or 17', respectively, that is, from the major plane of the frame. Usually, the bend line of the flaps is immediately adjacent the junction between the flaps and the frame; it can, however, be shifted towards the free ends of the flaps, for example by forming a prebending line or a crease, shown in FIG. 4 at 25*a*.

The precise shape of the pinch seal is no longer of importance for the particular guide element. Thus, seals with beads, that is, a double-T cross section, as well as for a pinch seal without lateral beads, and having only an I-shaped cross section, can be held by part 17, 17'. The guide part 17 reliably holds and guides the arc tube, regardless of the type and shape of pinch seal being used, and a single guide element may be used for a multiplicity of arc tubes having different sizes and shapes of pinch seals. This is in contrast to the prior art where the surrounding collars are suitable essentially only for one particular type and size of pinch seal and there, primarily, for I-shaped pinch seals.

Assembly of the arc tube is simple, since it need merely be pushed in the direction of the flaps through the opening, so that the flaps will then engage the pinch seal both at the flat as well as the edge sides thereof, as is clearly apparent from FIGS. 2 and 4.

Various changes and modifications may be made, and any features described herein in connection with any one of the embodiments may be used with any of the others, within the scope of the inventive concept. Angle $\alpha$ is not critical and may vary between 40°–70°.

In a further embodiment, the holder effect of the guide element may be enhanced by a grooved surface of the wide sides and/or by studs projecting from the narrow sides of the press seal.

We claim:

1. High-pressure discharge lamp having an outer bulb (2) and a base (4) secured to the outer bulb;

a double-ended arc discharge tube (8) formed with end pinch or press seals (10, 15), two current supply leads (11, 16), axially aligned with respect to the discharge tube extending through a respective pinch or press seal towards the outside thereof, and a fill of an inert gas, mercury and metal halides within the arc discharge tube; and holder means (6*a*, 6*b*, 7, 12) located in said outer bulb (2) and at least partly surrounding at least one of said pinch or press seals, and electrically connected to said current supply leads (11, 16), comprising, in accordance with invention, a guide element (17) formed of a punched sheet metal part having a major surface extending at least approximately transversely to the axis (A) of the lamp, said guide element (17) being secured to said holder means (7), said guide element further being formed with an opening (24) larger than the cross-sectional dimension of said one press seal, and with guide portions loosely, resiliently engaging against said one press seal, whereby said part will define a frame-type rim (21, 22, 23) fitting around, guiding, and loosely receiving said one (10) press seal.

2. The lamp of claim 1, wherein said opening (24) has an essentially rectangular shape;

and said guide portions comprise resilient flap means (25, 26; 25', 26') extending into said opening.

3. The lamp of claim 2, wherein said flap means are bent in a direction away from the major surface of said sheet metal part at an angle ($\alpha$) of between about 40° to 70° with respect to the major surface of said sheet metal part (17, 17').

4. The lamp of claim 1, wherein said sheet metal part (17) is further formed with a support arm (18) bent approximately 90° with respect to the major surface of said sheet metal part (17), said support arm being secured to said holder means (7).

5. The lamp of claim 4, wherein said support arm (18) is undulated or corrugated to permit bump-welding against a portion (12) of said holder means (6*a*, 6*b*, 7, 12).

6. The lamp of claim 1, wherein said sheet metal part (17) comprises an iron metal coated with a layer of nickel.

7. The lamp of claim 6, wherein the thickness of the iron sheet metal part is approximately 0.5 mm.

8. The lamp of claim 2, wherein the length of said flap means is up to about half the length of the side of the rectangle from which said flap means extends.

9. The lamp of claim 2, wherein a portion of the flap means which is adjacent the side of the rectangular opening, from which the respective flap means extends, is reduced in width with respect to the width of the flap means remote from said portion.

10. The lamp of claim 1, wherein said outer bulb (2) is single-ended; said holder means (6*a*, 6*b*, 7, 12) comprises a support means (12) extending towards the bulb in a region remote from said base (4);

and wherein said sheet metal part (17) surrounds the pinch or press seal (10) close to the base (4), and is secured to said support means forming part of the holder means (7).

11. A method of assembling a high-pressure discharge lamp having an outer bulb (2) and a base (4) secured to the outer bulb;

a double-ended arc discharge tube (8) formed with end press seals (10, 15), two current supply leads (11, 16), axially aligned with respect to the discharge tube extending through the pinch or press seal towards the outside thereof, and a fill of an inert gas, mercury and metal halides within the arc discharge tube; and holder means (6*a*, 6*b*, 7, 12) located in said outer bulb (2) and at least partly surrounding at least one of said pinch seals, and electrically connected to said current supply leads (11, 16), comprising, in accordance with the invention, forming a guide element (17) of punched sheet metal with an opening (24) therein and at least two flaps (25, 26) projecting from said opening at an angle ($\alpha$) with respect to a major surface of said guide element of punched sheet metal;

securing said guide element to a holder means (6*a*, 6*b*, 7, 12); and pushing one (10) of the press seals of the discharge vessel through the opening until the flaps engage against side surfaces of the press seal.

12. The method of claim 11, wherein said step of forming the guide element includes forming said opening in essentially rectangular form; the step of forming said flaps includes forming a flap extending from each of the four sides of the essentially rectangular opening, whereby four flaps will project from said opening;

forming a holding arm (18) on said guide element, extending at an essentially right angle with respect to the major surface of said guide element;

securing said holder arm to a portion (12) of said holder means (6*a*, 6*b*, 7, 12), to form a subassembly upon pushing of said discharge vessel through said opening for retention therein of one of said press seals;

and placing said subassembly in said outer bulb, and securing it within said outer bulb and to said base.

* * * * *